US006250638B1

(12) United States Patent
Youngquist

(10) Patent No.: US 6,250,638 B1
(45) Date of Patent: Jun. 26, 2001

(54) TAPER JOINT WELL SEALING PACKER AND METHOD

(76) Inventor: Timothy G. Youngquist, 15465 Pine Ridge Rd., Fort Myers, FL (US) 33908

( * ) Notice: Subject to any disclaimer, the term of this patent is extended or adjusted under 35 U.S.C. 154(b) by 0 days.

(21) Appl. No.: 09/241,645

(22) Filed: Feb. 1, 1999

(51) Int. Cl.[7] ..... F16J 15/08
(52) U.S. Cl. ..... 277/336; 277/338; 277/340
(58) Field of Search ..... 277/338, 336, 277/340, 603, 617, 625, 630, 626, 644; 285/331

(56) References Cited

U.S. PATENT DOCUMENTS

| | | | | |
|---|---|---|---|---|
| 1,411,486 | | 4/1922 | Gallagher . | |
| 2,130,598 | | 9/1938 | Penick | 103/155 |
| 3,311,168 | * | 3/1967 | Pierce, Jr. | 277/603 |
| 3,347,319 | | 10/1967 | Littlejohn | 166/242 |
| 3,399,548 | | 9/1968 | Burns | 64/23 |
| 4,291,767 | | 9/1981 | Hall | 166/290 |
| 4,619,326 | | 10/1986 | Van Mierio | 166/382 |
| 4,892,337 | * | 1/1990 | Gunderson | 285/333 |
| 5,685,369 | | 11/1997 | Ellis | 166/195 |
| 5,743,335 | | 4/1998 | Bussear | 166/285 |
| 5,775,429 | | 7/1998 | Arizmendi | 166/387 |

* cited by examiner

*Primary Examiner*—Anthony Knight
*Assistant Examiner*—Enoch E. Peavey
(74) *Attorney, Agent, or Firm*—Alvin S. Blum

(57) ABSTRACT

A downhole packer in a well removably seals an annular space between an inner tube and an outer tube or well casing in a well bore. The packer provides a metal to metal tapered seal between a female sealing element having a tapered inner sealing surface and a male sealing element having a tapered outer sealing surface. Each sealing element has tubing welded to upper and lower faces as required to provide a resealable annular space that may be filled with corrosion resistant fluid under pressure. The pressure is then monitored to detect leaks. Repairs may be made by lifting out the tube, repairing the leak, and lowering the tube until the two sealing surfaces mate.

11 Claims, 2 Drawing Sheets

FIG. 2
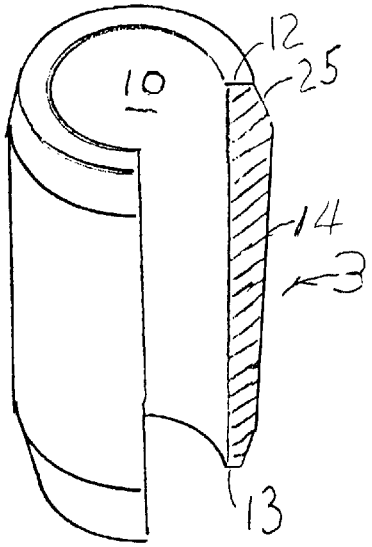
FIG. 3
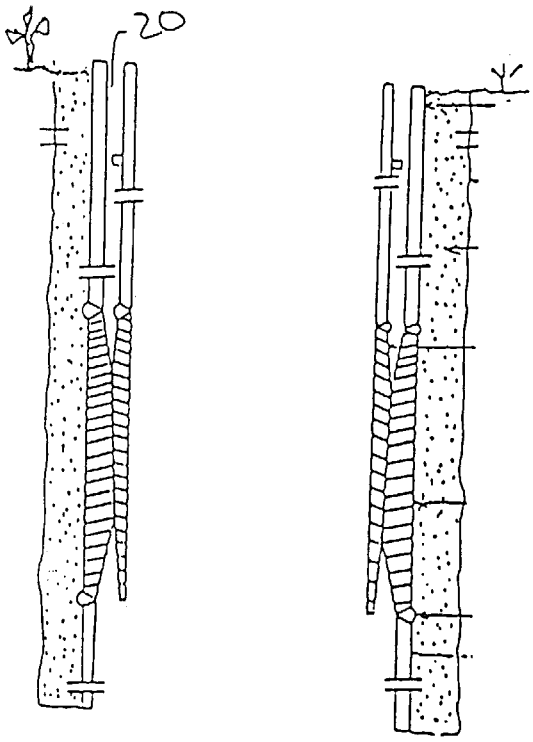
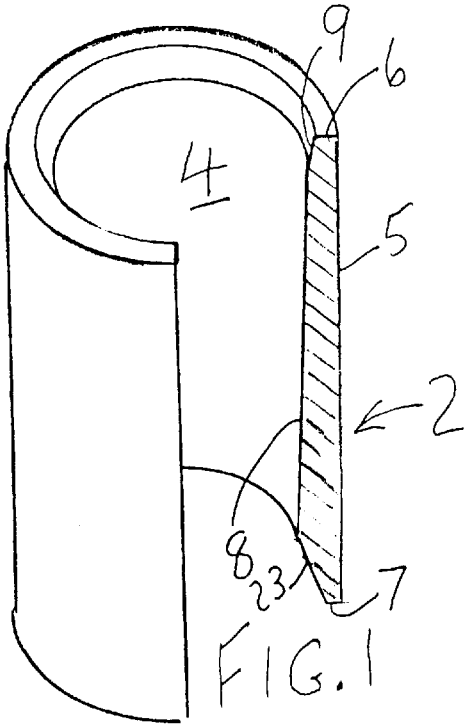
FIG. 1

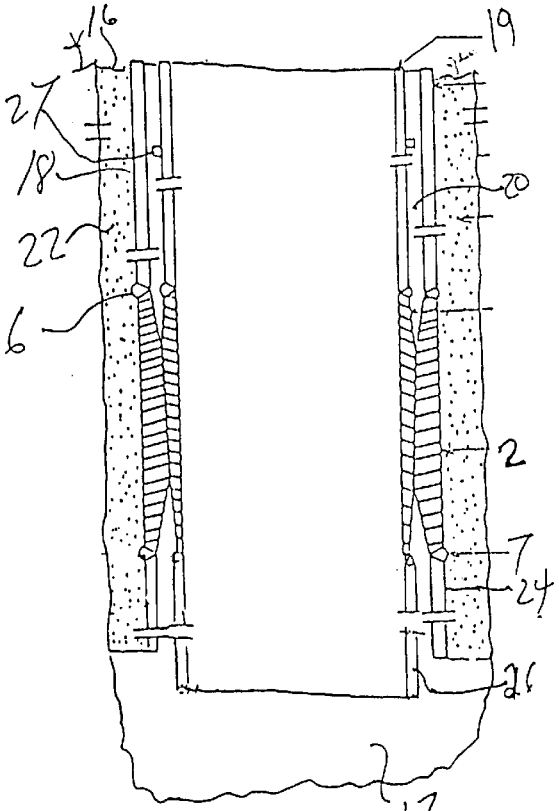
FIG. 4
FIG. 5
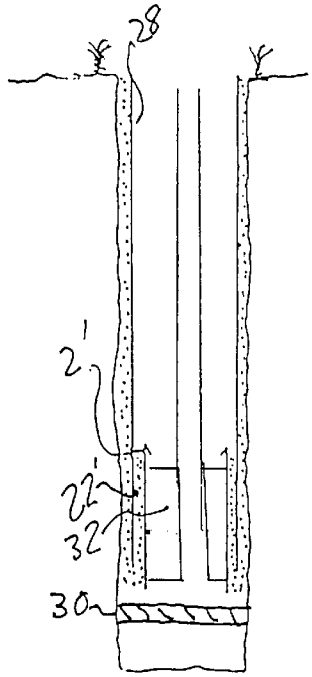
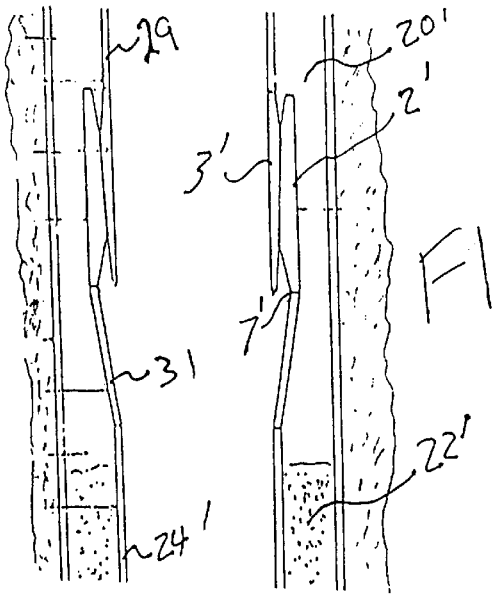
FIG. 7
FIG. 6
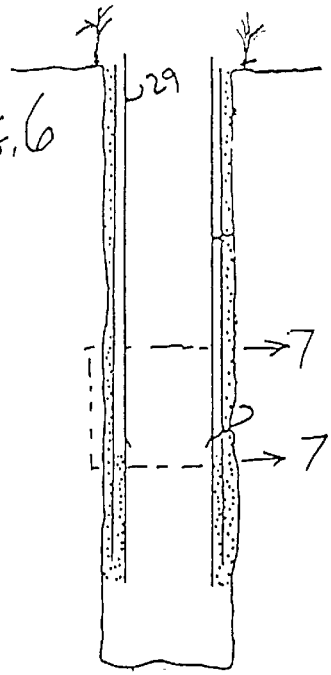

TAPER JOINT WELL SEALING PACKER AND METHOD

BACKGROUND OF THE INVENTION

This invention relates to the field of downhole packers in wells. More particularly, the present invention relates to metal to metal seals that removably seal the lower end of an annular space in a well such as between an inner tubing and an outer casing.

Downhole packers seal the annular space between a casing cemented in a well bore and the well tubing through which underground fluid is removed or other fluid is injected into the well.

In certain situations, such as in pumping treated wastewater down below an aquifer for environmentally safe disposal, it is essential that the wastewater pass through to the bottom of the well without leaking into the intermediate strata that would contaminate future water supplies. To ensure safe operation, an inner tube carrying the wastewater down is surrounded by an outer tube or well casing. A seal commonly referred to as a packer, seals the lower end of the annular space between the inner and outer tube close to the lower end of the inner tube. The annular space is then filled with fluid and pressurized. The pressure in the annular space is then monitored to detect any change in pressure, which would indicate a leak of fluid either into, or out of, the annular space. Since the environment to which the inner and outer tubes are exposed may be corrosive or may induce cracks from soil movement, temperature and pressure fluctuations and the like, it is imperative that any leakage be immediately known. It is useful to be able to release the seal and pull the inner tubing out for repair and reuse if possible. It is also useful to be able to introduce corrosion inhibiting fluid into the annular space. Resilient sealing surfaces have been used in the prior art, but they tend to deteriorate in the hostile environment encountered. Prior art sealing elements have been applied to the inner and outer surfaces of the tubing, but they tend to lack structural strength.

SUMMARY OF THE INVENTION

It is accordingly an object of the invention to provide an improved well packer apparatus that exhibits excellent long term sealing that resists leaking by use of a metal to metal contact sealing between complementary tapered sealing elements, one male and one female. It is another object that the seal be readily released and reused by simply lifting the inner tube up out of the bore for repair in a translatory motion.

This apparatus includes an annular outer seal member that is attached to a tubular well casing or outer tube that is insertable in the well bore. An annular inner seal member is attached to an inner tube at a lower end thereof, the combination fitting within the outer tube and passing down therethrough until the inner seal member flushly and sealingly engages the annular outer seal member to define an annular volume extending upwardly from the seal that may be filled with a corrosion resisting liquid whose pressure can be monitored for leak detection. The two tapered matching mating sections preferably have a slope of approximately 2½ degrees from the vertical. The outer seal member and the inner seal member both have a downwardly, and inwardly sloping smooth mating surface. There may be upper and lower, non-mating surfaces on the two sealing members to facilitate operation.

The inner pipe may also be provided with generally centering or stablizing means extending radially outwardly therefrom positioned above the inner sealing member to further facilitate sealing engagement.

These and other objects, advantages and features of the invention will become more apparent when the detailed description is studied in conjunction with the drawings in which like reference characters indicate like elements in the various drawing figures.

BRIEF DESCRIPTION OF THE DRAWINGS

FIG. 1 is a perspective, partially cut away view of a female tubular sealing element of the invention.

FIG. 2 is a perspective, partially cut away view of a male tubular sealing element of the invention.

FIG. 3 is an elevation cross sectional view of a well with the invention in place.

FIG. 4 is an elevation cross sectional view of a well with another embodiment of the invention in place.

FIG. 5 is a diagrammatic elevation view of an old well in the process of being retrofitted with another embodiment of the invention.

FIG. 6 is a diagrammatic elevation view as in FIG. 5 after completion of the retrofit.

FIG. 7 is an enlarged cross sectional view taken along the line 7—7 FIG. 6.

DETAILED DESCRIPTION OF PREFERRED EMBODIMENTS

Referring now first to FIGS. 1–4, a bore hole 17 deep down below the earth's surface 16 is lined with an outer tubing or caging 18 secured with cement 22 between the tubing 18 and the walls of the bore hole. A monolithic tubular female sealing element 2 has a straight outer cylindrical wall 5, and an inner cylindrical wall 4 provided with a downwardly and inwardly tapered non mating upper surface 9 having an angle to the vertical of greater than five degrees, an intermediate, tapered mating or sealing surface 8 extending downwardly and inwardly at an angle of about two and a half degrees from the vertical. Below surface 8 is another non mating surface 23 extending downwardly and outwardly at an angle of greater than five degrees from the vertical. An upper annular planar end 6 and a lower annular planar end 7 join the inner and outer cylindrical walls. The upper planar end 7 is welded to the bottom of outer tubing or casing 18 that extends continuously to the surface 16. An outer tubing segment 24 may be welded to the lower planar end 7. Cement 22 is pumped down the well until it rises up and fills and seals the space between the well bore and the outer cylindrical surface of the outer tubing and element 2.

A monolithic tubular male sealing element 3 has a straight inner cylindrical wall 10, and an outer cylindrical wall 11 with a downwardly and outwardly tapered non mating upper portion 25 having an angle from the vertical of greater than five degrees, an intermediate, smoothly tapered mating or sealing surface 14 extending downwardly and inwardly at an angle of about two and a half degrees from the vertical, and a downwardly and outwardly lower tapered non mating surface 23 extending at an angle of greater than five degrees from the vertical. An upper planar annular face 12 and a lower planar annular face 13 join the inner and outer cylindrical walls 10,11. Upper face 12 is welded to the bottom of an inner tubing 19 that extends continuously to the surface. A lower segment 26 of inner tubing is welded to the lower face 13.

After the outer tubing with sealing element 2 has been lowered into the borehole and cemented in place with cement 22, the inner tubing is lowered through the outer tubing until the mating surfaces 8 and 14 flushly and sealingly engage to form the tapered joint sealing means 1. The weight of the inner tubing forces the two surfaces tightly together. Both sealing elements 2,3 are machined from the same metal alloy to reduce electrolysis effects therebetween. The non mating tapered surfaces help to center and position the mating surfaces for sealing and facilitate disengagement when pulling the inner tubing out for repairs. A centering or stabilizing element 27 such as an annular ring may be fastened to the outer surface of tubing 19 above the seal. When the seal is made, an annular space 20 is formed between the inner and outer tubings that is sealed at its lower end by seal 1. This space 20 may be sealed at its upper end by means well known in the art (not shown) and filled with corrosion resistant fluid and then pressurized. The pressure is monitored to detect leaks.

Referring now to FIGS. 5–7, the invention is shown in another application in which an old well with casing 28 is retrofitted with a new system for removably sealing an annular space between the old casing and an inner tubing 29.

A drillable bridge plug 30, is first installed in the well by means well known in the art. A downwardly directed tubing segment 24' is welded to adapter 31 which is welded to lower face 7' of female sealing element 2'. This is attached to an inflatable packer 32, well known in the art, lowered into the well just above plug 30, and cement 22' pumped in between the new tubing and old casing. The inflatable packer is deflated and removed. The upper tubing 29 is welded to male sealing element 3' and lowered until the two tapered sealing surfaces seal off the annular space. Alternatively, the male sealing element may be cemented in below and the female element attached to the upper tubing (not shown).

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. Tapered joint sealing means for removably sealing a lower end of an annular space between an inner tubing and an outer tubing in which the lower end of the space is deep below a well surface in a well bore, and the inner and outer tubings extend continuously from the lower end of the space to the well surface, the sealing means comprising:

a monolithic female tubular element sealably connected to the outer tubing and having an inner cylindrical wall and an outer cylindrical wall joined by an upper planar end and a lower planar end;

the inner cylindrical wall having a tapered smooth metal sealing portion extending downwardly and inwardly;

a monolithic male tubular element having an inner cylindrical wall and an outer cylindrical wall joined by an upper planar face and a lower planar face, the outer cylindrical wall having a tapered smooth metal sealing portion extending downwardly and inwardly And constructed for mating in fluid tight flush sealing engagement with the sealing portion of the female element by translatory motion;

the inner tubing being welded to the upper planar face and extending upward therefrom to the surface so that it may be lifted with the male element up to the surface for repair when leakage into or out of the annular space has been detected.

2. The tapered joint sealing means according to claim 1, in which the upper planar end of the female tubular element is welded directly to a cut bottom edge of the outer tubing.

3. The tapered joint sealing means according to claim 2, in which a downwardly directed segment of outer tubing is welded to the lower planar end of the female tubular sealing element.

4. The tapered joint sealing means according to claim 3, further comprising a downwardly directed segment of inner tubing welded to the lower planar face.

5. The tapered joint sealing means according to claim 2, further comprising a downwardly directed segment of inner tubing welded to the lower planar face.

6. The tapered joint sealing means according to claim 1, further comprising a downwardly directed tubing segment means welded to the lower planar end of the female tubular sealing element for receiving cement between an earlier installed well casing and an outer cylindrical wall of said tubing segment means to thereby form a lower margin of said annular space.

7. The tapered joint sealing means according to claim 1, in which the tapered sealing portions of the male and female elements are at an angle of about two and one half degrees from the vertical.

8. The tapered joint sealing means according to claim 1, further comprising:

a downwardly and inwardly tapered non sealing portion of the inner cylindrical wall of the female tubular element above the sealing portion and directed at an angle greater than five degrees from the vertical; and a downwardly and inwardly tapered non sealing portion of the outer cylindrical wall of the male tubular element below the sealing portion and directed at an angle of greater than five degrees from the vertical, the two non mating portions facilitating positioning of the male element within the female element.

9. Tapered joint sealing means for removably sealing a lower end of an annular space between an inner tubing and an outer tubing in which the lower end of the space is deep below a well surface in a well bore, and the inner and outer tubings extend continuously from the lower end of the space to the well surface, the sealing means comprising:

a monolithic female tubular element sealably connected to one of an outer tubing or an inner tubing and having an inner cylindrical wall and an outer cylindrical wall joined by an upper planar end and a lower planar end, the inner and outer tubing extending continuously to a well surface;

the inner cylindrical wall having a tapered sealing portion;

a monolithic male tubular element having an inner cylindrical wall and an outer cylindrical wall joined by an upper planar face and a lower planar face, the outer cylindrical wall having a tapered sealing portion constructed for mating in fluid tight flush sealing engagement with the sealing portion of the female element;

the other of the inner tubing or the outer tubing being welded to the upper planar face and extending upward therefrom to the surface so that the inner tubing may be lifted with one of the male element or the female element up to the surface for repair when leakage into or out of the annular space has been detected.

10. The tapered joint sealing means according to claim 9, further comprising a downwardly directed tubing segment means welded to the lower planar face of the male tubular sealing element for receiving cement between an earlier installed well casing that comprises the outer tubing and an outer cylindrical wall of said tubing segment means to thereby form a lower margin of said annular space.

11. The tapered joint sealing means according to claim 10, in which the tapered sealing portions of the male and female elements are at an angle of about two and one half degrees from the vertical.

* * * * *